United States Patent [19]

Persson

[11] 4,018,378

[45] Apr. 19, 1977

[54] CARTON TRAY WITH COVER

[75] Inventor: Karl Rune Persson, Halmstad, Sweden

[73] Assignee: Sprinter Pack AB, Halmstad, Sweden

[22] Filed: Mar. 24, 1976

[21] Appl. No.: 669,860

[30] Foreign Application Priority Data

Apr. 3, 1975 Sweden ..... 7503827

[52] U.S. Cl. ..... 229/31 R; 229/36; 229/43

[51] Int. Cl.² ..... B65D 5/24; B65D 5/22

[58] Field of Search ..... 229/31 R, 36, 25, 24, 229/43, 45

[56] References Cited

UNITED STATES PATENTS

| | | | |
|---|---|---|---|
| 1,271,033 | 7/1918 | Hall | 229/31 R |
| 2,073,272 | 3/1937 | Wellman | 229/31 R X |
| 2,161,675 | 6/1939 | Hoag | 229/31 R |
| 2,527,167 | 10/1950 | Wauda | 229/36 |
| 2,777,629 | 1/1957 | Osteen | 229/36 |
| 3,010,638 | 11/1961 | Forrer | 229/45 |
| 3,110,436 | 11/1963 | Wagner | 229/43 |
| 3,423,008 | 1/1969 | Mykleby | 229/31 R |
| 3,580,478 | 5/1971 | Bemiss | 229/43 |
| 3,637,131 | 1/1972 | Gulliver | 229/36 |
| 3,917,155 | 11/1975 | Bemiss | 229/31 R |

*Primary Examiner*—Davis T. Moorhead

*Attorney, Agent, or Firm*—Ostrolenk, Faber, Gerb & Soffen

[57] ABSTRACT

The invention relates to a carton tray with a separate carton cover, the side walls of which form a continuous frame around the edges of the cover base and fit the upper end of the tray which is provided with downwardly foldable edge flaps intended to engage with the inside of the frame formed by the side walls of the cover when placed on the tray. The side walls of the cover are extended at their ends with end flaps lying along the inside of the frame formed by the side walls. At least some of the end flaps have a locking edge turned upwardly towards the base of the cover, said edges being substantially parallel to the cover base and at a predetermined distance below it. At least some of the edge flaps of the tray have in their outwardly and downwardly folded position a downwardly turned locking edge for cooperation with a corresponding locking edge of the respective end flap so that, when the cover is pressed down onto the tray, the respective locking edge of the cover in the region of the completely pressed-down position of the cover will pass over the locking edge of the adjacent edge flap so that the edge flap snaps into position and both locking edges come into locking abutment with each other.

4 Claims, 18 Drawing Figures

CARTON TRAY WITH COVER

BRIEF DESCRIPTION OF THE INVENTION

The present invention relates to a carton tray with a separate carton cover, the side walls of which form a continuous frame lying along the edges of the cover base and fitting around the upper end of the tray.

The object of the invention is to provide a tray enclosable with a cover, especially having a relatively large volume and intended for contents with relatively high volumetric weight, such as ready-prepared food, the tray and cover coacting in such a way that the cover can be releasably locked in a fitted-on position without heat sealing or similar closure, to enable replacement and relocking after opening. In certain known trays with covers, closing the cover takes place against edge flanges at the upper end of the tray, and when the cover is torn off, remains of carton material are left on the edge flanges of the tray in the shape of a fluffy layer, which is not acceptable in trays for certain purposes. An advantage with such known trays is, however, that by welding on the cover at the edges of the tray, a reinforcing frame is obtained around the upper end of the tray, so that the tray will be relatively rigid against twisting or bending, which in turn allows the use of the tray without inconvenience for contents with relatively high volumetric weight.

In combination with enabling the cover to be lockable to the tray without the assistance of heat sealing, the invention also aims at providing such a design of cover and tray that when the cover is fixed on the tray, the tray is considerably stiffer against twisting and bending than before fitting the cover.

The above-mentioned properties are obtained in a carton tray and cover which according to the invention have the characterizing features set forth in the following claims.

The tray according the the invention has along its periphery, at its upper end, a number of edge flaps which are capable of being folded out and down against the action of the springiness inherent in the carton material. This downward folding takes place in conjunction with fitting on the cover, which results in the edge flaps coming into resilient engagement with the inside of the frame formed by the side walls of the cover. The edge flaps lying along each side wall upper edge of the tray form, together with the upper edge portion of the contiguous side wall of the tray an angle section which results in considerable reinforcement of the upper edge of the tray. The side walls of the cover are provided with end flaps attached along the inside of the frame formed by the side walls of the cover, these end flaps being so made that they have a locking edge facing towards the base of the cover and substantially parallel thereto at a predetermined distance from the cover base. In their turn, all of the downwardly folded edge flaps of the tray have locking edges facing downwards in such a position that they snap over the locking edges of the cover when it is put on, and engage with said locking edges to retain the cover in a put-on position by these means. Further to the reinforcement of the tray which is obtained by the downwardly folded edge flaps, the corners of the tray can be so made in a particular manner according to the invention to provide still further strengthening of the tray.

BRIEF DESCRIPTION OF THE FIGURES

These and other advantages and details distinguishing the invention will now be explained more closely while referring to the accompanying drawings, which show some suitable embodiments of the tray with cover according to the invention.

FIG. 1 is a view from above of the tray before fitting the cover.

FIG. 2 is a cross section through the tray in FIG. 1.

FIG. 3 shows to an enlarged scale one corner portion of a blank for forming the tray in FIG. 1.

FIG. 4 is a view from above of a cover for the tray in FIG. 1.

FIG. 5 is a cross section through the cover in FIG. 4.

FIG. 6 is an enlarged plane view of one corner portion of a blank to the cover in FIGS. 4 and 5.

FIG. 7 is a fragmentary perspective view of one corner of the cover seen from the inside.

FIG. 8 is a cross section through the tray and cover after putting on and locking the cover.

FIG. 9 is an enlarged section taken diagonally through one corner of the tray with the cover on.

FIG. 11 shows the blank for the tray.

FIG.12 shows the blank for the cover.

FIG. 13 is a side view of the cover.

FIG. 14 is a partial section along line 14—14 in FIG. 13.

FIG. 15 is a side view of the tray before putting on the cover.

FIG. 16 is a partial section along line 16—16 in FIG. 15.

FIG. 17 is a side view of the tray with the cover put on and in a locked position.

FIG. 18 is a schematic partly broken perspective view of one corner portion of the tray with the cover in a locked position according to FIG. 17.

DETAILED DESCRIPTION OF THE INVENTION AND PREFERRED ITS EMBODIMENTS

Figure 1:
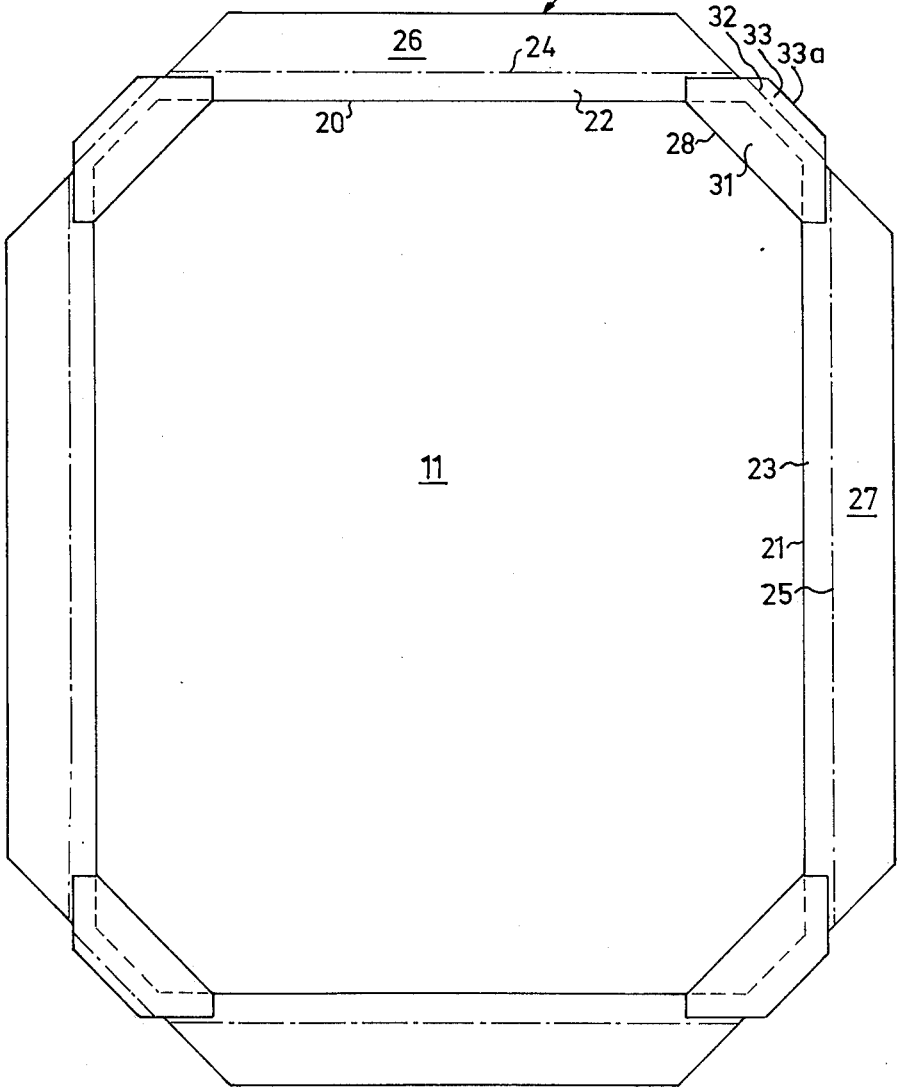
FIGS. 1–9 show an embodiment of a carton tray and the cover associated therewith, where
Figure 2:
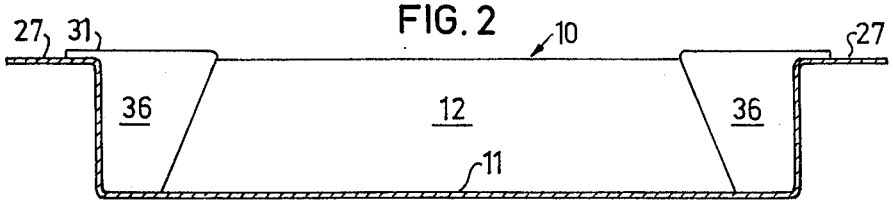
Figure 3:
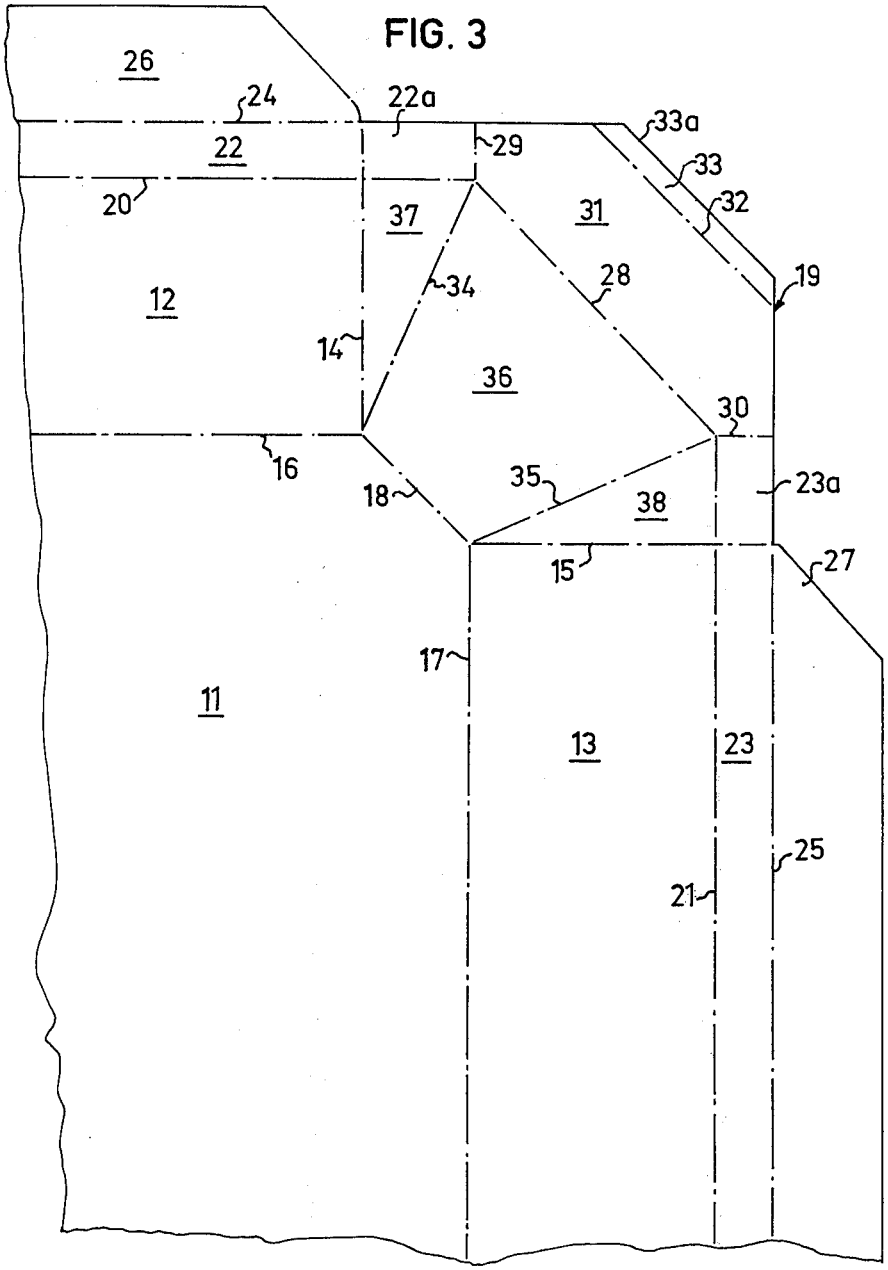

The tray 10 in FIGS. 1 and 2 is set up from a rectangular blank with four like corner portions, one being shown in FIG. 3. The tray has a bottom 11, two longitudinal side walls 12 and two transverse side walls 13.

The ends of the side walls are defined by end score lines 14,15 and the bottom edges of the side walls by the bottom score lines 16,17 which are connected to each other at the corners of the tray by slanting lower corner edge score lines 18.

At the respective corner, the side walls are connected by a corner panel 19, lying between the end score lines 14,15 and the corner edge score line 18.

The side walls 12,13 of the tray are between the bottom edge score lines 16,17 and the edge score lines 20,21 parallel thereto. Outside the latter there is a relatively narrow supporting edge panel 22,23 extending out to an edge score line 24,25 forming a hinge for folding down an edge flap 26 and 27 respectively.

The edge score lines 20,21 extend into the respective corner panel 19 as far as the ends of an upper corner edge score line 28, lying parallel to the lower corner edge score line 18.

The ends of the supporting edge panels 22,23 are defined by transverse score lines 29,30. Between these score lines and outside the intermediate upper corner edge score line 28 there is a portion of the corner panel which forms a communicating panel 31 between the supporting edge panels 22,23.

The outer end of the communicating panel 31 has a score line 32 defining a downwardly foldable edge flap 33.

Between the ends of the score line 18 and the ends of the score line 28 there extend score lines 34,35, separating the corner panel 19 further into a corner wall 36 and two triangular panels 37,38.

The blank shown in FIG. 3 is formed by the side walls 12,13 being simultaneously folded up as corner panels 19 are folded up and double folded at their ends along the score lines 14,34 and 15,35 respectively, so that the triangular panels 37,38 come to lie along the inside of respective contiguous side wall 12 or 13. A fold is also made in the end portions 22*a* and 23*a* of the stiffening edge panels 22,23 so that the end portions 22*a* and 23*a* will be folded in over the edge panels 22,23 and will lie between these and the communicating panel 31, whereat they are fixed in this position by heat-sealing or gluing in a known way. The carton thus erected has the appearance shown in FIGS. 1 and 2.

Figure 8:
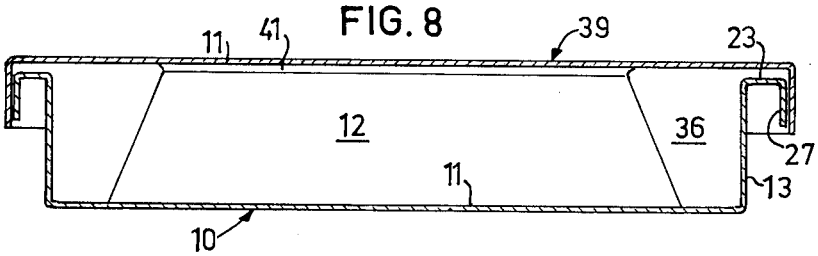
Figure 9:
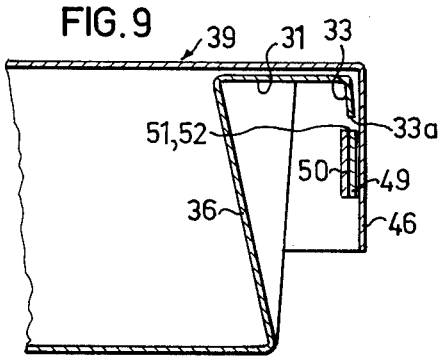

The stiffening edge panels 22,23 and the edge flaps 26,27 are in the same plane as each other, and the edge flaps 33 are in a plane with the communicating panel 31. As may be seen from FIGS. 1–3 the length of the side walls has been foreshortened by the corner wall being relatively wide, both upwardly along the score line 28 and downwardly along the score line 18. By reducing the length of the side walls in this way, their rigidity against bending and twisting is improved. Rigidity is moreover further increased in a way described below by the edge flaps 26,27,33 being bent down to the position shown in FIGS. 8 and 9, which results in a U-shaped edge profile at the upper end of the tray. This profile thus forms a heavy reinforcement of the upper edge of the tray along each of its side walls.

Figure 4:
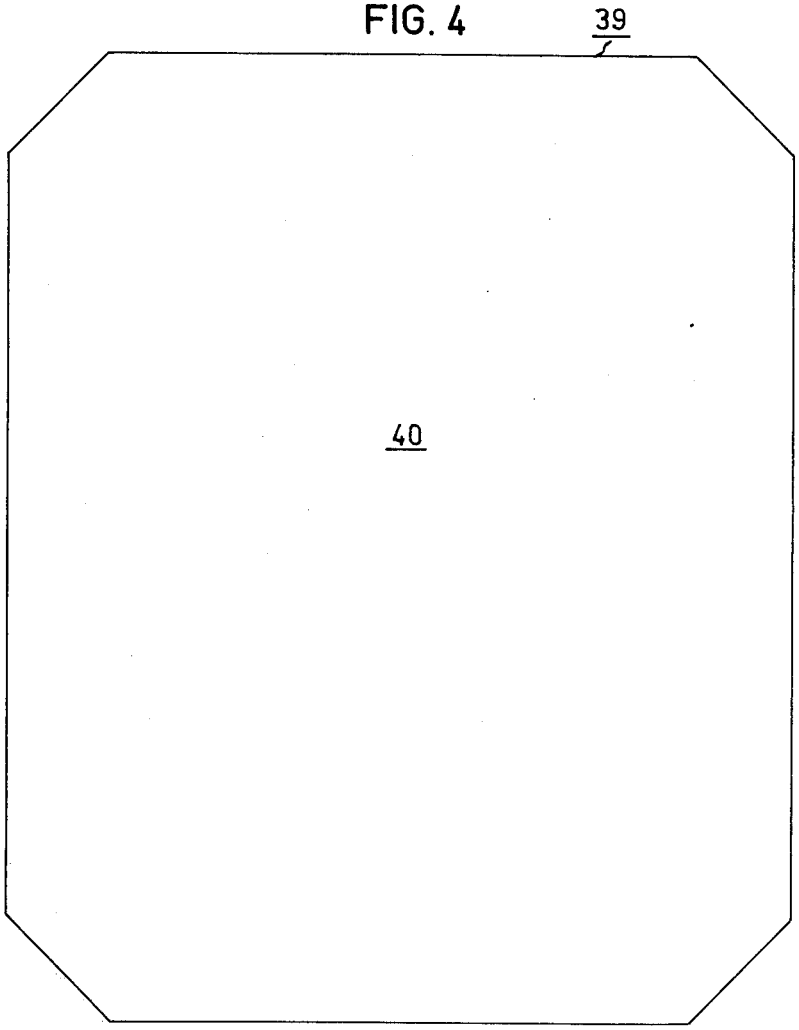
Figure 5:
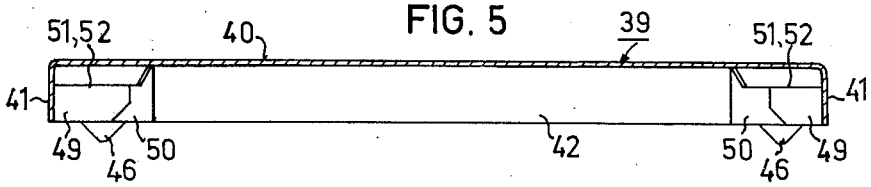
Figure 6:
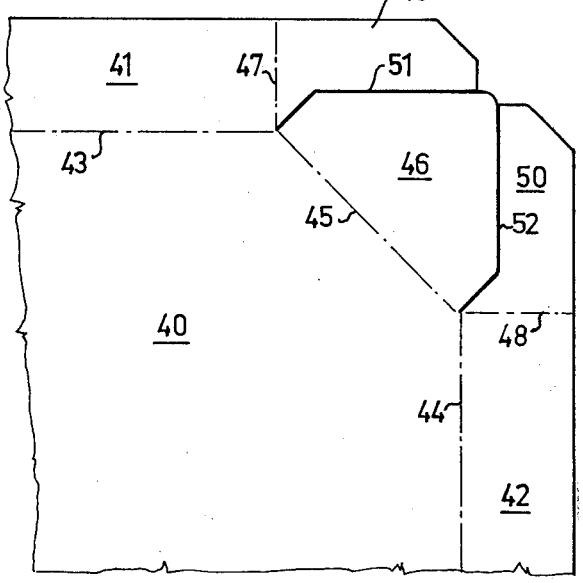

The cover 39 is FIGS. 4–7 is set up from the blank in FIG. 6. The cover has a base 40 with downwardly foldable side walls 41,42 at the edges. The fold is done along edge score lines 43, 44, extending to a slanting corner edge score line 45, forming a hinge for a corner flap 46.

The side walls 41, 42 extend to the end edge score lines 47,48 and outside these they are respectively extended with an end flap 49 and 50.

Each end flap has an outer edge forming a locking edge 51,52 which is substantially parallel to the respectiveedge score line 43 and 44 but displaced parallel in relation thereto in the example shown, where the side walls of the cover are intended to be substantially right-angular to the base in the erected corner.

Figure 7:
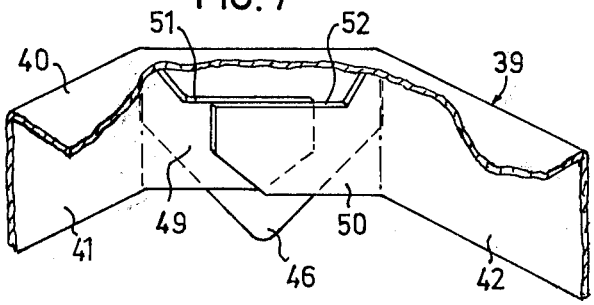

Erection of the cover takes place by the side walls 41,42 being folded down and the end flaps 49,50 being folded in over each other and fixed in that position as apparent from FIG. 7. The corner flap 46 is folded down over the end flaps and is fixed in this position as is also apparent from FIG. 7.

Since the locking edges 50,51 of the end flaps are arranged in the manner described above, they will together form an abutment lying at a previously determined distance below the base 40 of the cover. This is also apparent from FIG. 5.

When a cover according to FIGS. 4 and 5 is pressed onto a tray according to FIGS. 1 and 2 the following takes place. The side walls 41,42 of the cover will engage the edge flaps 26,27 of the tray and achieve sprung downward folding of these to the position shown in FIG. 8 to form the U-section round the top of the tray. At the corners of the tray, the lower edges of the end flaps 49,50 of the cover will springinglyfold down the corner edge flaps 33 so that these slide along the inside of the end flaps 49,50 until the locking end edge 33*a* of the corner edge flap 33 snaps over the locking edges 51, 52 of the end flaps and come into locking engagemeent therewith. Since the carton material is flexible with a certain resilience the edge flaps 26,27 of the tray will engage against the inside of the side walls 41,42 of the cover with a certain amount of spring bias, resulting in friction forces which contribute in retaining the cover on the tray. The same thing applies to the downwardly foldable corner edge flaps 33, engaging with a certain spring bias against the inside of the corner flap 46, as will be understood from FIG. 7. The positive lock is however achieved by the locking edge 33*a* of the downwardly foldable corner edge flaps abutting at least the locking edge 51 of the inner edge flap 49 as shown clearly in FIG. 9.

Figure 10:
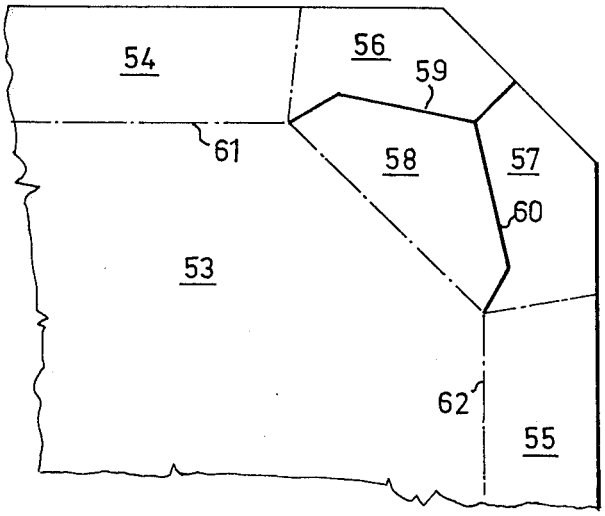
FIG. 10 is an enlarged fragmentary view of one corner portion in a modified embodiment of a blank for a conical cover fitting the tray in FIG. 1.

In FIG. 10 there is shown a modified embodiment of the cover with a cover base 53 and side walls 54,55 with end flaps 56,57 and a corner flap 58 at each corner of the cover. In this case as well, the end flaps 56,57 overlap each other in the erected cover, whereon the corner flaps 58 lie outside the end flaps. The corner flap is somewhat shorter than in FIG. 6 and the shape of the end flaps 56,57 is such that their locking edges 59,60 do not lie parallel to the respective side edge score line 61 and 62 but form an angle with it. This causes a slight outward inclination of the side walls 54,55 when the cover is set up, so that it tapers to allow stacking the covers one inside the other.

For the tray and cover according to FIGS. 11–18, the tray has no stiffening edge panel 22 at its upper edge as has the tray in FIG. 1, and locking the cover to the tray is not arranged at the corners of the tray as in the tray in FIG. 1 but to the ends of the side walls of the tray.

Figure 11:
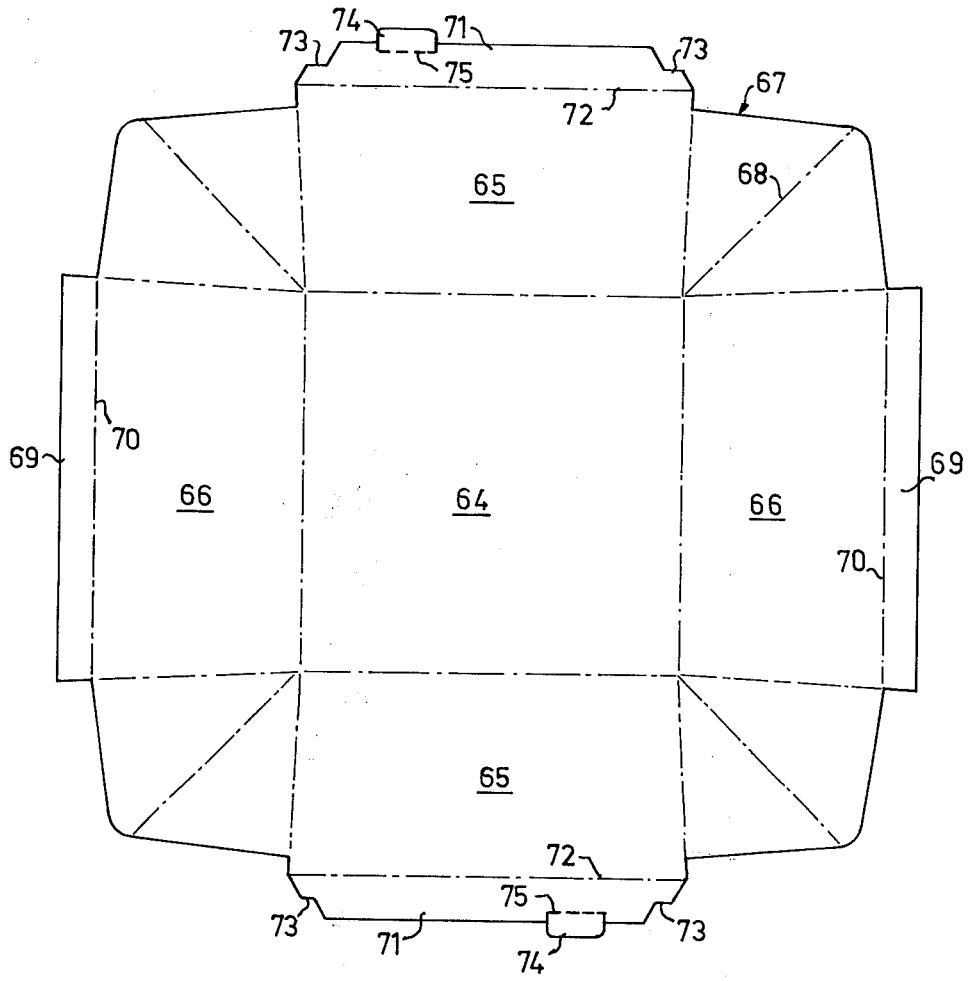
FIGS. 11–18 show another embodiment of a tray with cover according to the invention, where

The blank for the tray 63 is shown in FIG. 11, and has a bottom 64, four side walls 65,66 and corner panels 67 joining these, which can be folded double along diagonal score lines 68.

There are edge flaps 69 for two opposing side walls 66,66, and the flaps can be folded down along edge score lines 70.

There are also edge flaps 71 which can be folded down along edge score lines 72 for the other two side walls 65,65. These edge flaps 71 are suitably somewhat wider than the edge flaps 69, as shown.

The ends of the edge flaps 71 are made with cut-outs providing a locking edge 73 substantially parallel to the edge score line 72. Each edge flap 71 has also a sealing leaf 74 which can be folded along a perforated line 75.

The tray is set up in the usual manner by folding up the side walls, folding in the double-folded corner panels andfixing these against the side walls on the outside by heat sealing or gluing. The tray thus erected is tapering in the way shown in FIGS. 15 and 16, enabling the trays to be stacked one in the other before use.

Figure 15:
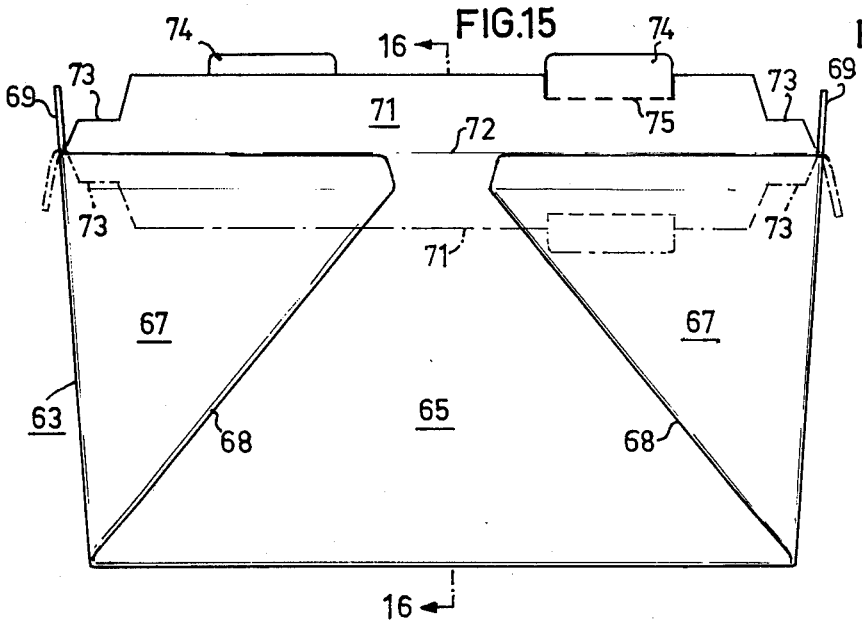
Figure 16:
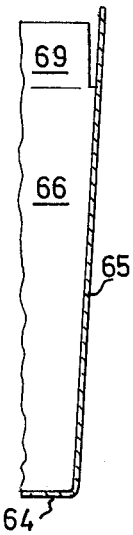
Figure 17:
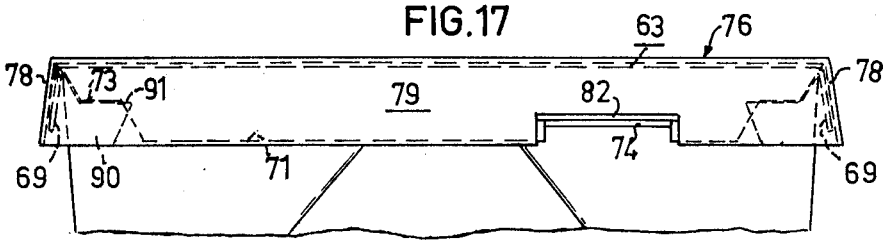
Figure 18:
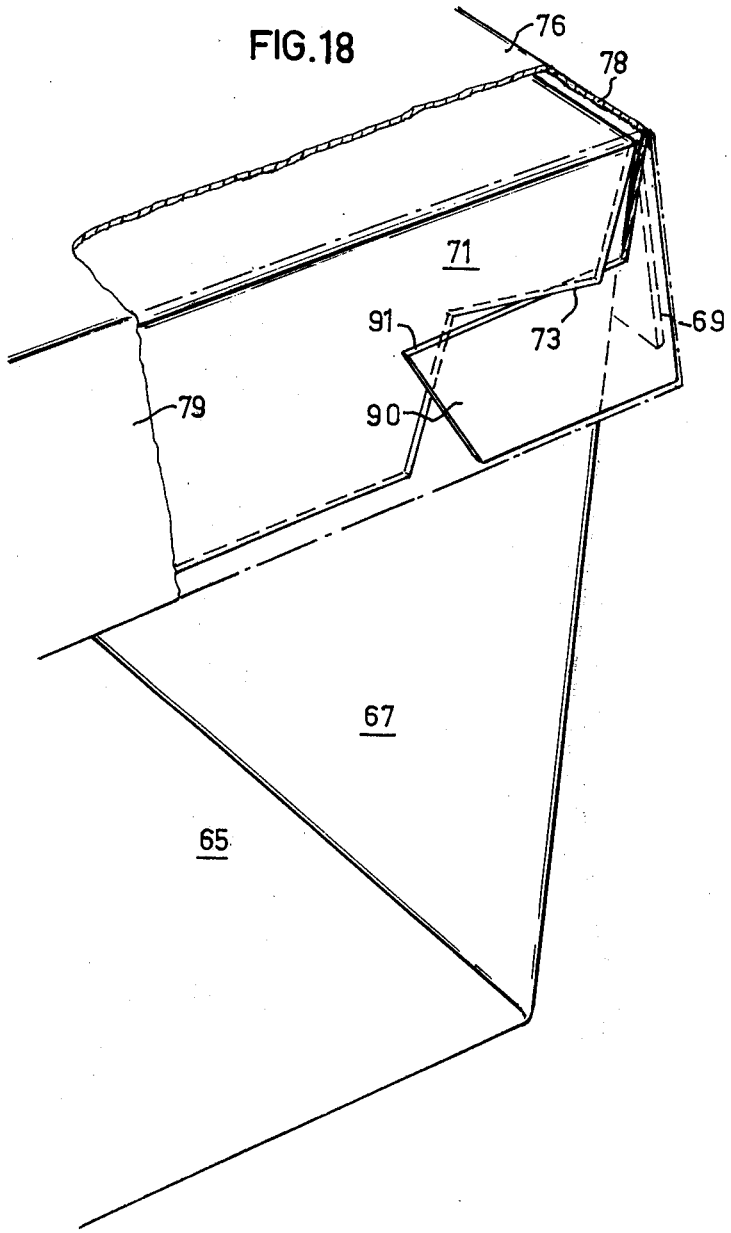

In FIG. 15 the edge flaps 71 are shown with full lines in their position when stacking the trays in each other and with chain dotted lines in this Figure in their folded-down position according to FIG. 17 when the cover is put on.

Figure 12:
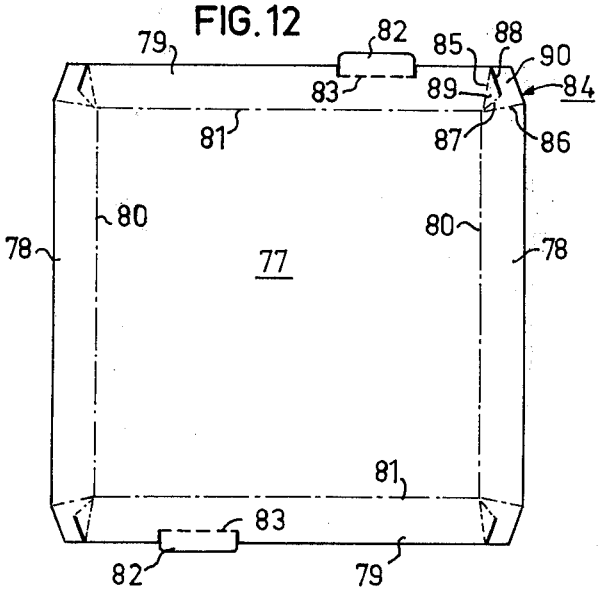
Figure 13:
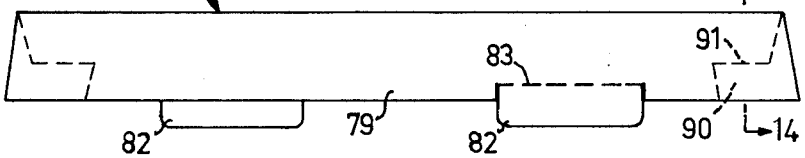
Figure 14:
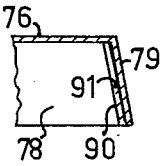

The cover 76 in FIGS. 13 and 14 is set up from the blank in FIG. 12. The cover has a base 77 and a continuous frame of side walls 78,79 which can be folded down along edge score lines 80,81. The side walls 79 are each provided with a sealing leaf 82, which can be folded along a perforated line 83 in the same way as the sealing leaf 74 on the tray in FIGS. 11 and 15.

The corner panels 84 between the ends of the side walls are defined by the end edge score lines 85,86, forming an acute angle with each other, so that the side walls will slope outwards somewhat when the cover is erected, to form a tapering stackable cover.

The corner panels have a diagonal score line 87 extending from the inner corner of the panel and a distance outwards on the panel to where a slit 88 meets the score line 87 defining, together with it and the adjacent end edge score line 85, a triangular panel 89.

The slit 88 makes possible corner end flap 90 with a locking edge 91 obtained by making the slit 88. When the cover is set up and the corners are glued or sealed, the end flaps 90 will lie on the inside of the frame formed by the side walls, and assume thereby the position indicated in FIGS. 13 and 14, the locking edge 91 of the end flap lying at a predetermined distance below the bottom of the cover base and facing towards it as is apparent from FIG. 14.

When the cover 76 of FIG. 13 is put on the tray 63 of FIG. 15, the edge flaps 69,71 are first folded outwards and then downwards so much that when the cover 76 is pressed down onto the tray, the lower edges of the cover side walls 78,79 will engage the edge flaps 69,71 and under spring bias fold them down to the position shown in FIG. 17. In this position the edge flaps 69,71 press resiliently outwards against the inside of the cover side walls 78,79 to provide a certain amount of retaining friction. The actual locking of the cover is accomplished by the locking edges 73 of the edge flaps snapping over the locking edges 91 of the end flaps 90, to come into locking abutment against these in the way which is especially clear from FIG. 18. From this Figure it may be seen that the locking edge 91 on the cover end flap is somewhat longer than the associated locking edge 67 on the tray end flap, so that the corner panels 67 of the end flap extends at an angle in over the locking edge 91 of the end flap and cannot come into full engagement therewith. By this means there is obtained a completely satisfactory lock, although it can be released in a simple way by gripping either one or both of the opposing side walls 79,79 of the cover and bending the side wall out a little at the same time as the cover is lifted up along this side wall. The engagement between both locking edges 73,91 is thereby released and the cover can be lifted off easily. In reverse, it is easy to reclose the tray by quite simply pressing the cover on again into the position shown in FIG. 17.

In a similar way as with the tray and cover according to FIGS. 1–10, there is obtained for the tray and cover according to FIGS. 11–18 a considerable strengthening of the upper edge of the tray by means of the U-profile formed by the upper portions of the tray walls and the associated downwardly folded edge flap at the respective side wall, as is apparent from FIG. 17. When the cover is in place, the sealing leaves are folded out so that the cover leaves 82 engage with the tray leaves 74. If so desired, each opposing pair of leaves can be sealed as a guarantee that the cover has not been taken off. This seal can easily be broken by tearing off the leaves along the perforated lines 75,83.

What I claim is:

1. A carton comprising:

a cover having a base and downwardly depending side walls which form a continuous frame around the edges of said cover base; said side walls of said cover being extended at their ends with end flaps lying along the inside of said frame formed by said side walls of said cover; at least some of said end flaps having a locking edge which is substantially parallel to said cover base and at a predetermined distance below it;

a tray including a tray base and side walls depending upwardly therefrom; said side walls of said tray being fixedly connected to each other by means of a corner construction consisting of a corner wall which forms a part of the inside of said tray and with its side edges engage against the inside of said side wall on either side of said corner; said side edges of said corner wall and the ends of contiguous side walls of said tray being united by means of an intermediate portion lying along the inside of the respective contiguous side wall; said side walls of said tray each including an edge flange lying in a plane substantially parallel to said tray base, said edge flanges being fixedly united to each other by each corner wall being extended with a communicating panel at its upper edge which lies on top of adjacent and portions of said side wall edge flanges and is sealed to them; the end edges of adjacent side walls of said tray being separted such that the bottom edge of each said corner wall forms an obliquely extending bottom edge uniting the ends of the bottom edges of adjacent side walls; each of said edge flanges and said communicating panels being extended with an edge flap which can be folded down along a score line lying along the outer edge of the respective edge flange or communicating panel so that when said cover is placed onto said tray, said edge flaps of said tray will be turned down by said side walls of said cover to give the edge portion of said tray a U-profile with relatively great resistance to bending when said cover is in said tray;

at least some of said edge flaps of said tray having a downwardly turned locking edge for cooperation with a corresponding locking edge of one of said end flaps of said cover in such a way that when said cover is pressed down into said tray, the respective locking edge of said cover passes over said locking edge of an adjacent edge flap of said tray so that said end flap of said cover snaps into position and said locking edges of said tray and cover come into locking abutment with each other.

2. A carton tray as claimed in claim 1, wherein at least some of said edge flaps extending from said communicating panels have a locking edge parallel to the score line along which the respective edge flap is folded; and wherein the corner portions of the cover include a downwardly folded corner flap the end flaps of adjacent side walls being sealed to the inside of said corner flap and each other in such a manner that the upper edges of the end flaps form locking edges at the same height in relation to each other but at such a distance below the base of the cover that they form an abutment against which the locking edge of the adjacent edge flap of the tray is intended to engage in the locking position.

3. A carton tray as claimed in claim 1, wherein the cover locking edges are arranged in notches at the ends of the downwardly foldable edge flaps of the side walls.

4. A carton tray as claimed in claim 3, wherein the end flaps of the cover lie along the inside of either one of two opposing side walls of said cover and are formed with locking edges intended to coact with the locking edges of the edge flaps of the tray.

* * * * *